US006784825B1

(12) United States Patent
Kubota et al.

(10) Patent No.: US 6,784,825 B1
(45) Date of Patent: Aug. 31, 2004

(54) RADAR REFLECTOR APPARATUS

(75) Inventors: Osamu Kubota, Kanagawa (JP); Shigeru Wada, Kanagawa (JP); Shigeki Akamatsu, Kanagawa (JP)

(73) Assignee: Japan Aircraft Manufacturing Co., Ltd., Kanagawa (JP)

( * ) Notice: Subject to any disclaimer, the term of this patent is extended or adjusted under 35 U.S.C. 154(b) by 0 days.

(21) Appl. No.: 10/409,556

(22) Filed: Apr. 8, 2003

(51) Int. Cl.[7] ..... H01Q 15/00
(52) U.S. Cl. ..... 342/5; 342/8; 342/10
(58) Field of Search ..... 342/1, 5, 7, 8, 342/10, 12

(56) References Cited

U.S. PATENT DOCUMENTS 2,534,710 A * 12/1950 Golian et al. ..... 441/20
4,503,101 A * 3/1985 Bennett ..... 428/9
4,901,081 A * 2/1990 Bain et al. ..... 342/8
6,061,012 A * 5/2000 Sakimura ..... 342/5
6,104,358 A * 8/2000 Parker et al. ..... 343/915
6,570,545 B1 * 5/2003 Snow et al. ..... 343/915
2003/0137441 A1 * 7/2003 Garon et al. ..... 342/8

FOREIGN PATENT DOCUMENTS

JP 2002096795 A * 4/2002 ..... B63C/9/20

* cited by examiner

*Primary Examiner*—John B. Sotomayor
*Assistant Examiner*—Isam Alsomiri
(74) *Attorney, Agent, or Firm*—Lawrence E. Laubscher, Jr.

(57) ABSTRACT

There is provided a radar reflector apparatus that is mounted in a lifeboat or a small rescue boat or in a floating buoy used for salvage or search practice, or is used by itself independently, to serve as a radar wave reflector of a search radar. The radar reflector apparatus has a simple structure, and is folded when not in use, and when used, is unfolded automatically when dropped by a marine vessel or aircraft or the like.

1 Claim, 3 Drawing Sheets

RADAR REFLECTOR APPARATUS

BACKGROUND OF THE INVENTION

1. Field of the Invention

The present invention relates to a radar reflector apparatus that is mounted in a lifeboat or a small rescue boat or in a floating buoy used for salvage or search practice, or is used by itself independently, to serve as a radar wave reflector of a search radar. In particular, the invention relates to a radar reflector apparatus with a simple structure, that is folded when not in use, and when used, is unfolded automatically when dropped by a marine vessel or aircraft or the like.

2. Description of the Related Art

One conventional radar reflector apparatus of this type is known as a folding reflector. In this folding reflector apparatus, there are prepared three rectangular plates each of which is formed with a slit running up to the center along a diagonal line from one corner portion of a rectangular plate towards the opposite comer portion, and the three rectangular plates are assembled by fitting the slits together so that the three rectangular plates intersect each other at right angles at comer portions, thereby forming a comer section that reflects radar waves.

Another type of radar reflector apparatus is an automatically unfolding type that employs gas. In this unfolding type radar reflector apparatus, reflective plates with flexibility substantially the same as the plates of the above folding reflector apparatus are placed inside a vinyl ball shaped like a beach ball. When not in use, the internal gas is released and the vinyl ball is folded. When used, a carbon dioxide gas cartridge, for example, installed inside the vinyl ball is operated so as to fill the interior of the vinyl ball with carbon dioxide gas. The vinyl ball is thus inflated and the reflective plates inside the vinyl ball are unfolded.

However, in the above conventional folding reflector apparatus, at the time of use, it is necessary for a user on-site to assemble the three rectangular plates by fitting together the slits. This operation may be troublesome, and there have been cases where the apparatus has not been able to be employed rapidly. Moreover, in the automatic unfolding type radar reflector apparatus that employs a vinyl ball, the above problem does not occur because the reflective plates are unfolded automatically at the time of use. However, it is necessary for the flexible reflective plates to be placed inside the vinyl ball and for a carbon dioxide gas cartridge to be installed inside the vinyl ball. As a result, the structure becomes complex and the manufacturing cost of this apparatus becomes high.

SUMMARY OF THE INVENTION

In order to solve the above problems, it is an object of the present invention to provide a radar reflector apparatus with a simple structure, that is folded when not in use, and when used, is unfolded automatically when dropped by, for example, a marine vessel or aircraft or the like.

In order to achieve the above object, the radar reflector apparatus according to the present invention comprises: a support pillar standing vertically upright; a plurality of arms joined to a lower end portion of the support pillar, that are unfolded from a folded state in which they are substantially parallel to the support pillar to a state in which they are substantially perpendicular to the support pillar so as to be positioned in radial; elastic members provided between the support pillar and each arm, that unfolds the arms from the folded state in which they are substantially parallel to the support pillar to the state in which they are substantially perpendicular to the support pillar; and flexible reflective membranes provided under tension between the support pillar and the respective arms and between adjacent arms, that are capable of being folded and unfolded.

According to the above construction, it is possible to unfold the plurality of arms joined to the lower end portion of the support pillar standing vertically upright from the folded state in which the arms are substantially parallel to the support pillar to the state in which they are substantially perpendicular to the support pillar, using the elastic members provided between the support pillar and the respective arms, and also to unfold the flexible reflective membranes provided under tension between the support pillar and the respective the arms and between adjacent arms. Accordingly, it is possible to provide a radar reflector apparatus with a simple structure, that is folded when not in use, and when used, is unfolded automatically when dropped by, for example, the marine vessel or aircraft or the like. In addition, since the structure is simple, it is possible to achieve a reduction in cost.

DESCRIPTION OF THE PREFERRED EMBODIMENTS

Figure 1:
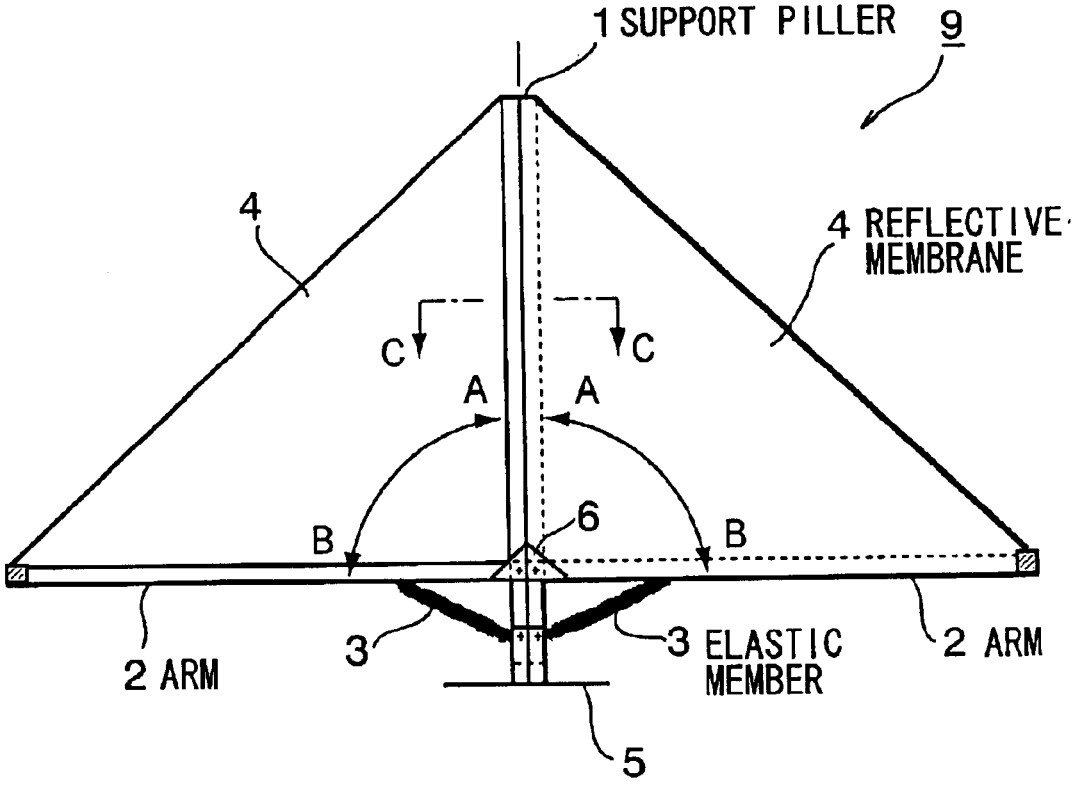
FIG. 1 is a front elevational view showing an embodiment of a radar reflector apparatus according to the present invention.
Figure 2:
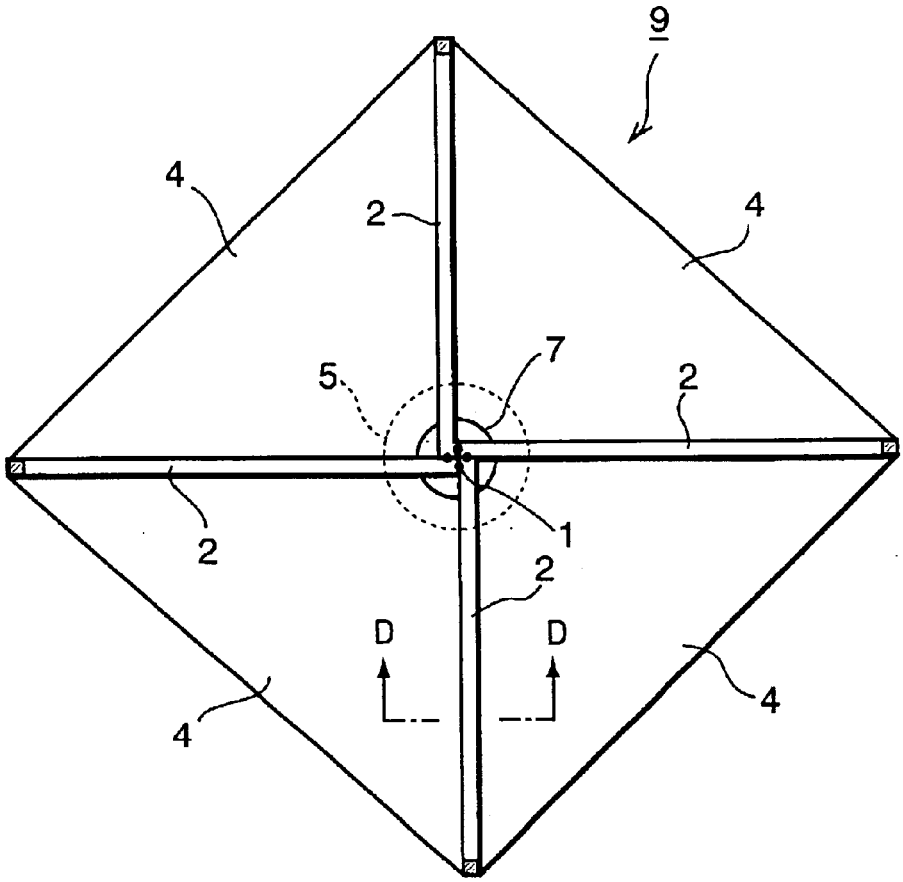
FIG. 2 is a plan view of FIG. 1.

FIG. 1 is a front elevational view showing an embodiment of a radar reflector apparatus according to the present invention, while FIG. 2 is a plan view thereof. The radar reflector apparatus is mounted in a lifeboat or a small rescue boat or in a floating buoy used for salvage or search practice, or is used by itself independently, to serve as a radar wave reflector, and comprises a support pillar 1, arms 2, elastic members 3, and reflective membranes 4.

Figure 3:
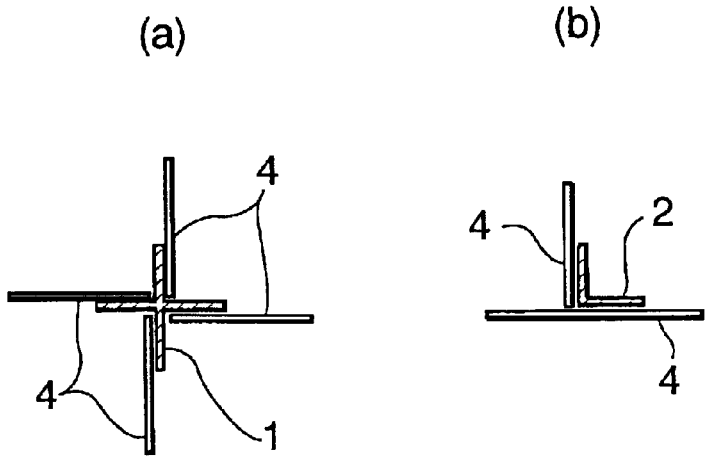
FIG. 3 is a view showing a structure of the main portion of the above radar reflector apparatus; (a) being a cross-sectional view taken along the line C—C in FIG. 1, and (b) being a cross-sectional view taken along the line D—D in FIG. 2.

The support pillar 1 is a central member of the radar reflector apparatus, and stands vertically upright with a length of, for example, approximately 330 mm. The support pillar 1 is formed, for example, from metal or plastic in a pillar shape having a cruciform cross section (see (a) of FIG. 3). A base plate 5 having, for example, a circular configuration is provided perpendicularly to the longitudinal direction of the support pillar 1 at a lower end of the support pillar 1.

As shown in FIG. 2, at a position slightly above the lower end of the support pillar 1, a plurality of arms 2 are provided so as to extend in radial. These arms 2 are used to stretch the reflective membranes 4 to be described below between the arms 2 and the support pillar 1 and also between the respective arms 2, and are formed, for example, from metal or plastic or the like in a shape of angle (see (b) of FIG. 3) with a length of approximately 280 mm. Inner end portions of the arms 2 are rotatably joined to hinges 6 provided at the lower end portion of the support pillar 1. As a result of being joined to the hinges 6, the arms 2 are unfolded from a folded state in which they are substantially parallel to the support pillar 1 to a state in which they are substantially perpendicular thereto, to be positioned in radial. Here, in the example shown in FIG. 2, a state is shown in which four arms 2 are unfolded in four directions orthogonal to each other.

The elastic members 3 are provided between the support pillar 1 and the respective arms 2. These elastic members 3 unfold the arms 2 in directions indicated by arrows A and B from the folded state in which the arms 2 are substantially parallel to the support pillar 1 to the state in which they are substantially perpendicular thereto. Each elastic member 3 is formed by a spring with one end portion thereof being connected to the vicinity of the lower end of the support pillar 1, while the other end portion thereof being connected to a central portion of the arm 2, to exert a tensile force. The elastic member 3 is not limited to the spring that exerts the tensile force, but may also be formed by a spring with one end portion thereof being connected to a central portion of the support pillar 1 and the other end portion thereof being connected to the central portion of each arm 2, to exert a repelling force.

The reflective membranes 4 are provided under tension respectively between the support pillar 1 and each arm 2 and between adjacent arms 2. The reflective membranes 4 reflect radar waves generated by a search radar from a marine vessel or aircraft or the like, as a radar reflector apparatus, and are formed from flexible material that is capable of reflecting radar waves and is also capable of being folded and unfolded such as, for example, silver paper, paper covered with aluminum foil or the like. The reflective membranes 4 that are provided under tension respectively between the support pillar 1 and each arm 2 and between adjacent arms 2 are each formed in a triangular configuration and are stretched such that surfaces of the respective reflective membranes 4 are substantially perpendicular to each other. As a result, radar waves from all directions from the search radar become able to be efficiently reflected. In FIG. 2, numeral 7 indicates a hole opened in the central portion of the reflective membranes 4.

Figure 4:
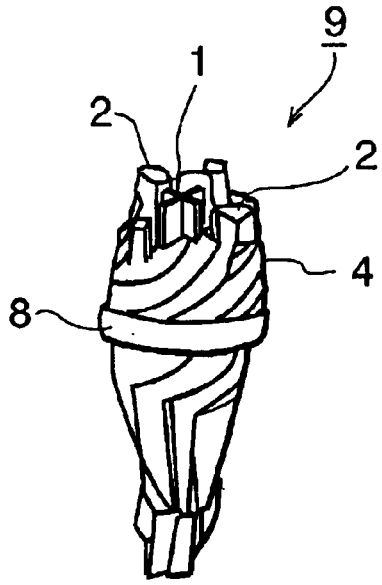
FIG. 4 is a perspective view showing a no use state of the above radar reflector apparatus, in which the entire apparatus is folded.

There is also provided temporary holding means 8 for holding the arms 2 and reflective membranes 4 such that they are not unfolded, in the state in which the respective arms 2 shown in FIG. 1 are each folded in the directions shown by the arrows A so as to be substantially parallel to the support pillar 1 and the reflective membranes 4 are folded like an umbrella, as shown in FIG. 4. As shown in FIG. 4, this temporary holding means 8 is formed by, for example, a tape, band, or ring that encircles the outer circumference of the reflective membranes 4 when these are folded like an umbrella Attentively, when the entire radar reflector apparatus 9 folded like an umbrella is housed inside, for example, a cylinder shaped or box shaped container, the container itself may serve as the temporary holding means 8. Thus, it is possible to hold temporarily the plurality of arms 2 and the reflective membranes 4 in the folded state by the temporary holding means 8, to prevent the arms 2 and reflective membranes 4 from unexpectedly being unfolded.

Next, a description will be given of the use of the radar reflector apparatus 9 that is constructed in above manner. Firstly, when being stored or transported prior to use, the radar reflector apparatus 9 that has been assembled in the manner shown in FIGS. 1 and 2 is in the state in which the arms 2 are folded in the direction of the arrows A in FIG. 1 so as to be substantially parallel to the support pillar 1, and the reflective membranes 4 are folded like a folded umbrella as shown in FIG. 4. At this time, because the respective arms 2 and reflective membranes 4 are urged to be unfolded by the elastic members 3 in the directions of the arrows B in FIG. 1, either the temporary holding means 8 shown in FIG. 4 is set, or else the radar reflector apparatus 9 is housed inside the container, to be held so that they are not unfolded.

Next, in this state, the temporary holding means 8 is removed by an operator when dropping the radar reflector apparatus 9 by the marine vessel or aircraft for example, or the radar reflector apparatus 9 housed in a suitable container is dropped together with the container and the container then is opened automatically or opened after a predetermined time, the holding state of the arms 2 and reflective membranes 4 is released.

Figure 5:
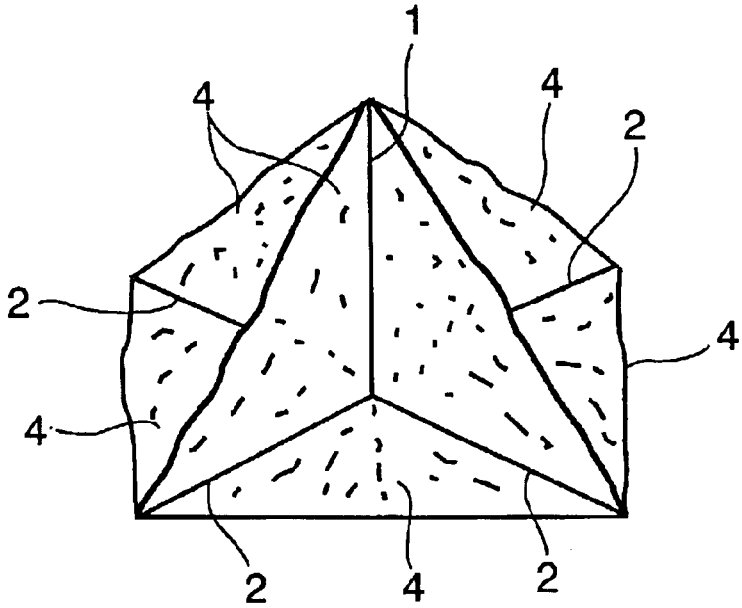
FIG. 5 is a perspective view showing a state of use of the above radar reflector apparatus, in which the entire apparatus is unfolded.

Consequently, due to the elastic force of the elastic members 3 shown in FIG. 1, the four arms 2 are respectively unfolded in the direction of the arrows B, so as to be automatically opened up into a substantially perpendicular state relative to the support pillar 1. At this time, each arm 2 is stopped when it hits against an upper face of the hinge 6 provided at the lower end portion of the support pillar 1 in FIG. 1 and, as described above, is fixed in the substantially perpendicular state relative to the support pillar 1. Then, as shown in FIG. 5, in this state, the reflective membranes 4 that are provided under tension between the support pillar 1 and the respective arms 2 and between adjacent arms 2 are stretched so that the surfaces thereof are substantially perpendicular to each other, and are unfolded so as to become possible to efficiently reflect radar waves from all directions from the search radar.

Thereafter, the radar reflector apparatus 9 is used while mounted in the lifeboat or the small rescue boat or in the floating buoy used for salvage or search practice, or is used by itself independently.

In the above description, there are four arms 2, however, the present invention is not limited threreto and three arms, or five arms, or six or more arms may also be employed.

What is claimed is:

1. A radar reflector apparatus comprising:

a support pillar which stands vertically upright and includes a base plate at a lower end portion thereof;

a plurality of arms joined to said support pillar in the vicinity of said lower end portion, said arms being unfolded from a folded state in which they are substantially parallel to said support pillar to a state in which they are substantially perpendicular to said support pillar so as to be positioned in radial;

elastic members provided between said lower end portion of said support pillar and an intermediate portion of each arm, said elastic members applying tensile forces to said arms to unfold said arms from the folded state in which they are substantially parallel to said support pillar to the state in which they are substantially perpendicular to said support pillar;

flexible reflective membranes provided under tension between said support pillar and said respective arms and between adjacent arms, said reflective membranes being provided only above said arms and capable of being folded and unfolded; and temporary holding means in a tape shape for winding around an outer periphery of said reflective membranes such that said arms and reflective membranes are not unfolded, when folding said plurality of arms to the state in which they are substantially parallel to said support pillar while also folding said reflective membranes.

* * * * *